US006437491B1

(12) United States Patent
Estrera et al.

(10) Patent No.: US 6,437,491 B1
(45) **Date of Patent: *Aug. 20, 2002**

(54) SYSTEM FOR ENHANCED VISION EMPLOYING AN IMPROVED IMAGE INTENSIFIER WITH AN UNFILMED MICROCHANNEL PLATE

(75) Inventors: Joseph P. Estrera, Dallas; Anthony J. Nico, Allen, both of TX (US); Keith T. Passmore, Fincastle, VA (US); Timothy W. Sinor, Murphy; Robert H. Smithson, Garland, both of TX (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/326,253

(22) Filed: Jun. 4, 1999

(51) Int. Cl.[7] ..... H01J 43/00

(52) U.S. Cl. ..... 313/103 CM; 313/103 R; 313/105 R; 313/105 CM; 313/524; 313/527

(58) Field of Search ..... 313/103 CM, 103 R, 313/105 R, 105 CM, 524, 525, 526, 527, 528

(56) References Cited

U.S. PATENT DOCUMENTS 4,051,403 A * 9/1977 Feingold et al. ..... 313/105 CM
6,049,168 A * 4/2000 Iosue et al. ..... 313/542
6,297,474 B1 * 10/2001 Estrera et al. ..... 250/214

* cited by examiner

*Primary Examiner*—Vip Patel
*Assistant Examiner*—Kevin Quarterman
(74) *Attorney, Agent, or Firm*—Baker Botts L.L.P.

(57) ABSTRACT

The present invention comprises a photon detector and image generator, which includes a photocathode that receives photons from an image. The photocathode discharges electrons in response to the received photons. A microchannel plate with an unfilmed input face and an output face receives the electrons from the photocathode and produces secondary emission electrons which are emitted from the output face. A display receives the secondary electrons and displays a representation of the image. The photon detector and image generator has a lifetime of more than 7,500 hours.

9 Claims, 2 Drawing Sheets

SYSTEM FOR ENHANCED VISION EMPLOYING AN IMPROVED IMAGE INTENSIFIER WITH AN UNFILMED MICROCHANNEL PLATE

RELATED APPLICATIONS

This application is related to copending U.S. application Ser. No. 09/326,054, entitled "METHOD AND SYSTEM FOR MANUFACTURING MICROCHANNEL PLATES" copending U.S. application Ser. No. 09/326,252, entitled METHOD AND SYSTEM FOR ENHANCED VISION EMPLOYING AN IMPROVED IMAGE INTENSIFIER AND REDUCED HALO" copending U.S. application Ser. No. 09/326,148, entitled METHOD AND SYSTEM FOR ENHANCED VISION EMPLOYING AN IMPROVED IMAGE INTENSIFIER WITH GATED POWER SUPPLY AND REDUCED HALO" and copending U.S. application Ser. No. 09/326,359, entitled METHOD AND SYSTEM FOR ENHANCED VISION EMPLOYING AN IMPROVED IMAGE INTENSIFIER WITH GATED POWER SUPPLY".

TECHNICAL FIELD OF THE INVENTION

This invention relates generally to vision systems and more particularly to a method and system for enhanced vision employing an improved image intensifier.

BACKGROUND OF THE INVENTION

Image intensifier tubes are used in night vision devices to amplify light and allow a user to see images in very dark conditions. Night vision devices typically include a lens to focus light onto the light receiving end of an image intensifier tube and an eyepiece at the other end to view the enhanced imaged produced by the image intensifier tube.

Modern image intensifier tubes use photocathodes. Photocathodes emit electrons in response to being exposed to photons from an image. The electrons are produced in a pattern that replicates the original scene. The electrons from the photocathode are accelerated towards a microchannel plate. A microchannel plate is typically manufactured from lead glass and has a multitude of channels, each one operable to produce a cascade of secondary electrons in response to an incident electron.

Therefore, photons impinging on the photocathode produce electrons which are then accelerated to a microchannel plate where a cascade of secondary electrons are produced. These electrons are accelerated towards a phosphorous screen, where their collisions with the screen produces an image of the original scene.

A drawback to this approach is that the electrostatic fields in the image intensifier are not only effective in accelerating electrons from the photocathode to the microchannel plate and from the microchannel plate to the screen, but also moves any positive ions back to the photocathode at an accelerated velocity. Current image intensifiers have a high indigenous population of positive ions. These are primarily due to gas ions in the tube, including in the microchannel plate and the screen. These include both positive ions and chemically active neutral atoms. When these ions strike the photocathode, they can cause both physical and chemical damage. This leads to short operating lives for image intensifiers.

To overcome this problem, an ion barrier film can be placed on the input side of the microchannel plate. This ion barrier is able to block the ions from the photocathode.

One drawback of the ion barrier is that it reduces the signal to noise ratio of the image intensifier. This is due to the fact that the barrier is detrimental to ion transport.

Therefore, current image intensifiers require an ion barrier since current manufacturing techniques fail to remove enough gas molecules. But the presence of the ion barrier film reduces the signal to noise ratio. What is needed is an unfilmed (i.e. without ion barrier film) microchannel plate that has sufficient gas ions removed such that an image intensifier manufactured with such a microchannel plate has a usable life.

SUMMARY OF THE INVENTION

In accordance with the present invention, the disadvantages and problems associated with previous image intensifiers have been substantially reduced or eliminated. In particular, the present invention provides a method and system for enhanced vision employing an improved image intensifier.

In one embodiment a photon detector and image generator is provided which includes a photocathode that receives photons from an image. The photocathode discharges electrons in response to the received photons. A microchannel plate with an unfilmed input face and an output face receives the electrons from the photocathode and produces secondary emission electrons which are emitted from the output face. A display receives the secondary electrons and displays a representation of the image. The photon detector and image generator has a lifetime of more than 7,500 hours.

Technical advantages of the present invention include providing an image enhancer with improved signal to noise ratio and a long-lived photocathode and image intensifier. Another technical advantage is providing a microchannel plate that can operate in an image intensifier without an ion barrier being applied. Other technical advantages of the present invention will be readily apparent to those skilled in the art from the following figures, descriptions and claims.

BRIEF DESCRIPTION OF THE DRAWINGS

For a more complete understanding of the present invention, the objects and advantages thereof, reference is now made to the following descriptions taken in connection with the accompanying drawings in which.

DETAILED DESCRIPTION OF THE DRAWINGS

The preferred embodiment of the present invention and its advantages are best understood by referring to FIGS. 1 through 4 of the drawings, like numerals being used for like and corresponding parts of the various drawings.

Figure 1:
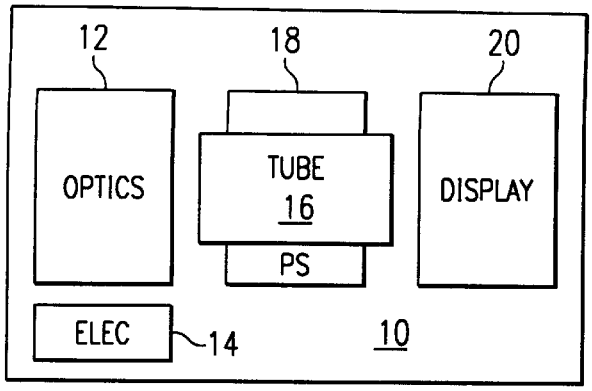
FIG. 1 is a schematic design of an image intensifier in accordance with the teachings of the present invention

FIG. 1 is a schematic design of an image intensifier 10 in accordance with the teachings of the present invention. Image intensifier 10 is operable to receive photons from an image and transform them into a viewable image. Image intensifier 10 is designed to operate and enhance viewing in varying light conditions including conditions where a scene is visible with natural vision and conditions where a scene is totally invisible with natural vision because the scene is illuminated only by star light or other infrared light sources. However, it will be understood that, although the image intensifier 10 may be used to enhance vision, the image intensifier 10 may also be used in other applications involving photon detection such as systems to inspect semiconductors.

Image intensifier 10 comprises optics 12 coupled to image intensifier tube 16. Image intensifier 10 is operable to act as a photon detector and image generator. Power supply 18 is coupled to image intensifier tube 16. Image intensifier tube 16 also can include an image visualization means 20 for viewing the image produced by image intensifier 10.

Optics 12 are generally one or more lens elements used to form an objective optical assembly. Optics 12 are operable to focus light from a scene on to image intensifier tube 16.

Power supply 18 is operable to provide power to components of image intensifier tube 16. In a typical embodiment power supply 18 provides continuous DC power to image intensifier tube 16. The use of power supply 18 is further described in conjunction with FIG. 2.

Electronics 14 represents the other electronic necessary for image intensifier 10. These include electronics that are used to control among other things, power supply 16.

Image visualization means 20 is operable to provide a convenient display for images generated at image intensifier tube 16. Image visualization means 20 may be as simple as a lens or can be a cathode ray tube (CRT) display.

Figure 2:
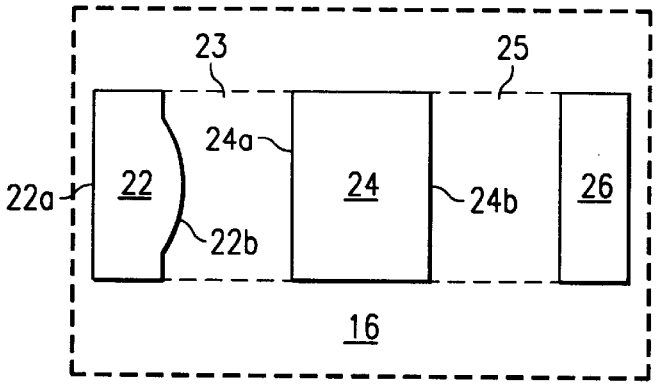
FIG. 2 illustrates an image intensifier tube in accordance with the teachings of the present invention.

FIG. 2 illustrates an image intensifier tube 16 in accordance with the teachings of the present invention. Image intensifier tube 16 comprises a photocathode 22 having a input side 22*a* and an output side 22*b*. Coupled to photocathode 22 is a microchannel plate (MCP) 24 having a MCP input side 24*a* and a MCP output side 24*b*. A first electric field 23 is located between photocathode 22 and microchannel plate 24. Also included is a phosphorous screen 26 coupled to microchannel plate 24. Between phosphorous screen 26 and microchannel plate 24 is a second electric field 25.

In operation, photons from an image impinge on input side of photocathode 22*a*. Photocathode 22 converts photons into electrons, which are emitted from output side of photocathode 22*b* in a pattern representative of the original image. Typically, photocathode 22 is a circular disk like structure manufactured from semiconductor materials mounted on a substrate as is well known in the art. One suitable arrangement is gallium arsenide (GaAs) mounted on glass, fiber optics or similarly transparent substrate.

The electrons emitted from photocathode 22 are accelerated in first electric field 23. First electric field 23 is generated by power supply 18. After accelerating in first electric field 23, the electrons impinge on the input side 24*a* of microchannel plate 24. Microchannel plate 24 typically comprises a thin glass wafer formed from many hollow fibers, each oriented slightly off axis with respect to incoming electrons. Microchannel plate 24 typically has a conductive electrode layer disposed on MCP input side 24*a* and MCP output side 24*b*. A differential voltage, supplied by power supply 18, is applied across the MCP input 24*a* and MCP output 24*b*. Electrons from photocathode 22 enter microchannel plate 24 where they produce secondary electrons, which are accelerated by the differential voltage. The accelerated secondary electrons leave microchannel plate 24 at MCP output 24*b*.

As discussed earlier, typical current microchannel plates contain an ion barrier on the input side in order to protect the photocathode from positive ions that travel from the MCP to the photocathode. These ions are typically gas ions trapped in the glass of the microchannel plate during processing. These ions are usually large and can cause physical and chemical damage to the photocathode if liberated from the microchannel plate and allowed to strike the photocathode. For conventional microchannel plates this problem leads to a very short image intensifier life (260 to 300 hours) when the ion barrier is not present. However, as discussed earlier, the ion barrier reduces the signal to noise ratio of image intensifier 10.

In the present invention, a microchannel plate without an ion barrier is provided for use in an image intensifier. In the present invention, even though the microchannel plate has no ion barrier, the life of the image intensifier is long (over 7,500 hours). Additionally, the signal to noise ratio is also very large (at least 27 to 1). This is achieved by providing a microchannel plate that is practically free from harmful ions.

After exiting microchannel plate 24 and accelerating in second electric field 25, secondary electrons impinge on phosphorous screen 26, where a pattern replicating the original image is formed. Other ways of displaying an image such as using a charged coupled device can also be used.

Figure 3:
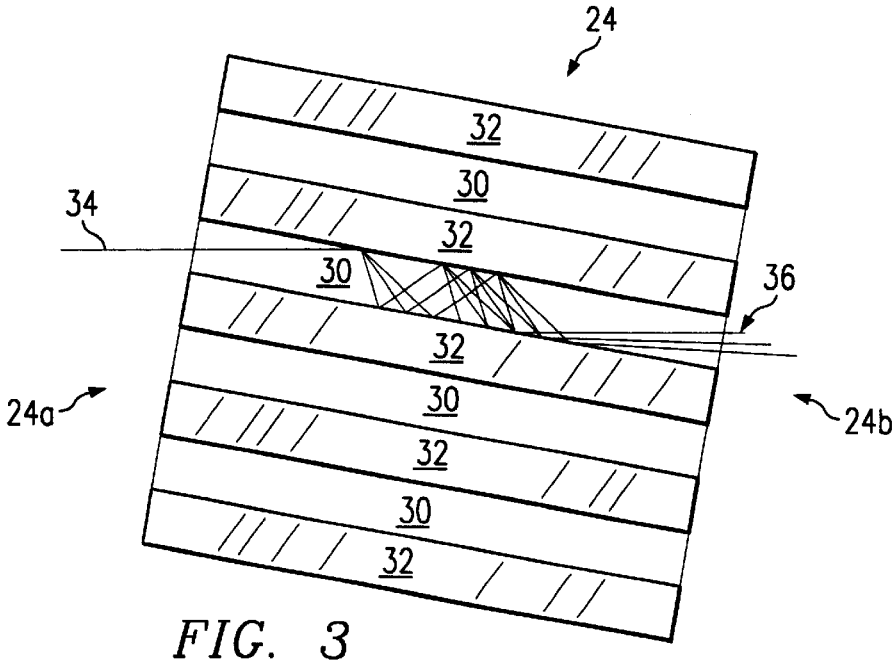
FIG. 3 illustrates a microchannel plate in accordance with the teachings of the present invention.

FIG. 3 illustrates a microchannel plate 24 in accordance with the teachings of the present invention. Illustrated is microchannel plate 24 comprising microchannel plate channels 30 and glass borders 32. As is illustrated in FIG. 3, incoming electrons 34 produce secondary emission electrons 36 by interactions in MCP 24.

In the present invention MCP input side 24*a* does not have an ion barrier film applied. The cladding glass used to manufacture microchannel plate 24 is made electrically conductive to produce secondary emission electrons and can be scrubbed to substantially reduce the amount of damaging ions. An example of suitable cladding glass is disclosed in U.S. Pat. No. 5,015,909, issued to Circon Corporation on May 14, 1991 and entitled "Glass composition and method for manufacturing a high performance microchannel plate". Other similar cladding glass material can also be used. As discussed earlier, each face (MCP input side 24*a* and MCP output side 24*b*) are made to act as electrodes. This is done by depositing a metallic coating such as Nichrome on the MCP input side 24*a* and MCP output side 24*b*. The channels are treated in such a way that incoming electrons produce secondary emission electrons. This is typically done by forming a semi-conducting layer in channels 30. The manufacture of a microchannel plate sufficiently low in ions such that it can be used unfilmed in an image intensifier is discussed in conjunction with FIG. 4.

Figure 4:
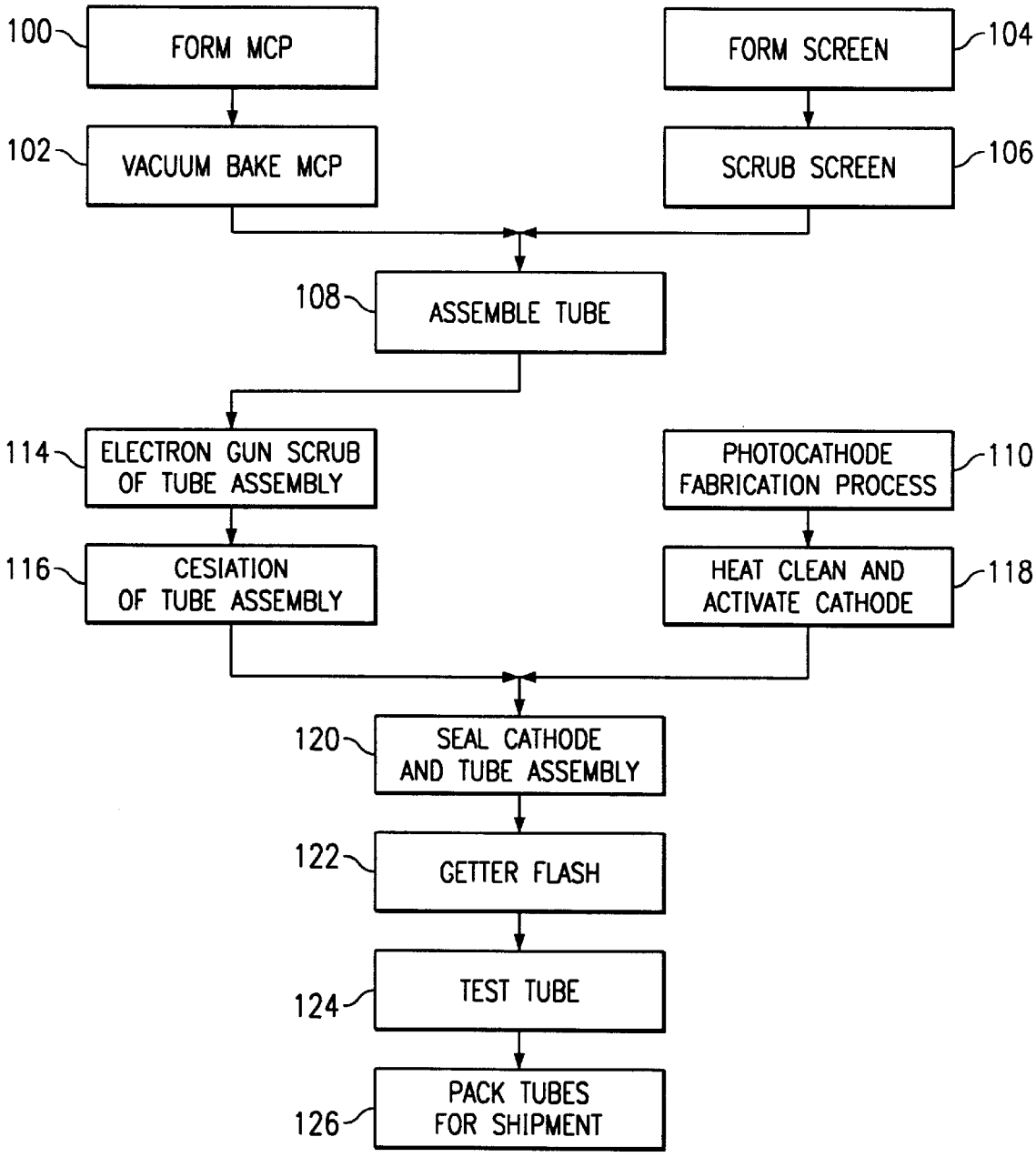
FIG. 4 is a flowchart illustrating the formation of an enhanced image device utilizing an unfilmed microchannel plate.

FIG. 4 is a flowchart illustrating the formation of an enhanced image device utilizing an unfilmed microchannel plate. In Step 100, a microchannel plate is formed. Microchannel plates are typically formed using a draw/multidraw technique in which many individual tubes are drawn (pulled) along a long axis several times to reduce the width of the tubes. The tubes are then sliced into individual microchannel plates.

In Step 102, the microchannel plate is baked in a vacuum to drive off ions, such as gas ions, in the microchannel plate. In Step 104, the phosphorus screen or CCD is prepared. In Step 106, the screen is scrubbed to remove unwanted gas impurities such as carbon dioxide, carbon monoxide, hydrogen gas and other impurities. In Step 108, the MCP and screen are placed together in a ceramic or metal input body to form a tube assembly.

In Step 110, a photocathode is formed. The photocathode is typically formed from a semiconductor with GaAs or InGaAs layer on a transparent substrate.

In Step 114, the tube assembly undergoes an electron beam scrub. The electron beam scrub uses a high-energy electron beam to drive out gas impurities that might later contribute to damaging ions. Typically a high intensity electron beam scrub is done over a long period of time.

One drawback to such an electron beam scrub of an unfilmed microchannel plate is that the intensity maybe such that the electrons leaving the MCP could burn a hole, or other wise damage, the phosphorous screen. To avoid this, the focus of the electron beam must be set to diffuse the high energy electrons before they reach the screen.

In Step 116, the tube assembly goes through a cesiation process. Cesium is a good gas eliminator (also known as a gas getter) which is used to remove even more gas based impurities from the screen and microchannel plate.

In Step 118, the photocathode undergoes a heat cleaning and a cesium activation step. In the heat cleaning step, the photocathode is heated in a vacuum to drive off any oxide layers. Next, a cesium activation step is performed. This is done to form a cesium and oxygen layer on top of the photocathode to protect the photocathode. This is done using a conventional process, which exposes the photocathode to cesium until an optimal amount of cesium is placed on the photocathode.

After Steps 116 and 118, the MCP/screen elements are assembled together in step 120. In Step 122, a wire of Ti/Ta is used as a final gas getter to remove any last impurities. After this is completed, the tube is tested in Step 126 after the finally tube assembly occurs in Step 126.

While the invention has been particularly shown and described by the foregoing detailed description, it will be understood by those skilled in the art that various other changes in form and detail may be made without departing from the spirit and scope of the invention.

What is claimed is:

1. A device for photon detection and image generation comprising:

a photocathode operable to receive photons from an image, the photocathode further operable to discharge electrons in response to the received photons;

a microchannel plate having an unfilmed input face and an output face, the microchannel plate receiving the electrons from the photocathode and producing secondary emission electrons in response, the secondary electrons emitting from the output face;

a screen operable to receive the secondary emission electrons and display a representation of the image; and wherein the lifetime of the device is more than 7,500 hours.

2. The device of claim 1, wherein the signal to noise ratio of the device is at least 27.

3. The device of claim 1, wherein the photocathode and the microchannel plate are provided as part of an image intensifier tube.

4. The device of claim 1, wherein the device is used for night vision devices.

5. The device of claim 1, wherein the microchannel plate is practically free from ionic impurities.

6. A photon detector comprising:

a photocathode; and an unfilmed microchannel plate coupled to the photocathode, the photon detector having a signal to noise ratio of at least 27.

7. The photon detector of claim 6, wherein the life of the photon detector is at least 7,500 hours.

8. The photon detector of claim 6, further comprising a screen coupled to the microchannel plate.

9. The photon detector of claim 8, wherein the photon detector is used for night vision devices.

* * * * *

UNITED STATES PATENT AND TRADEMARK OFFICE

CERTIFICATE OF CORRECTION

PATENT NO. : 6,437,491 B1
DATED : August 20, 2002
INVENTOR(S) : Joseph P. Estrera et al.

It is certified that error appears in the above-identified patent and that said Letters Patent is hereby corrected as shown below:

Title page,
Item [73], Assignee: change "Northrop Grumman Corporation, Los Angeles, CA (US)" to -- Litton Systems, Inc. --.

Signed and Sealed this

Fifteenth Day of April, 2003

JAMES E. ROGAN
*Director of the United States Patent and Trademark Office*